US005960093A

United States Patent [19]

Miller

[11] Patent Number: 5,960,093

[45] Date of Patent: Sep. 28, 1999

[54] MINIATURE TRANSDUCER

[75] Inventor: Thomas E. Miller, Arlington Heights, Ill.

[73] Assignee: Knowles Electronics, Inc., Itasca, Ill.

[21] Appl. No.: 09/050,508

[22] Filed: Mar. 30, 1998

[51] Int. Cl.[6] ..... H04R 25/00

[52] U.S. Cl. ..... 381/324; 381/328; 381/418; 381/200

[58] Field of Search ..... 381/417, 418, 381/200, 322, 324, 328

[56] References Cited

U.S. PATENT DOCUMENTS

| | | | |
|---|---|---|---|
| 3,251,954 | 5/1966 | Carlson | 381/418 |
| 3,515,818 | 6/1970 | Tibbetts | 381/189 |
| 5,068,901 | 11/1991 | Carlson | 381/328 |
| 5,193,116 | 3/1993 | Mostardo | 381/328 |
| 5,222,050 | 6/1993 | Marren et al. | 381/328 |

FOREIGN PATENT DOCUMENTS

WO 95/07014 3/1995 WIPO .

*Primary Examiner*—Sinh Tran
*Attorney, Agent, or Firm*—Wallenstein & Wagner, Ltd.

[57] ABSTRACT

A miniature transducer such as for an in-the-canal hearing aid, is disclosed. The transducer comprises a housing formed of a top cup joined to a bottom cup and defines an interior and an exterior. The bottom cup includes a base surface and a plurality of interconnected walls. The transducer further comprises a motor including a coil, a stack and an armature disposed substantially within the bottom cup. The housing includes an opening and a portion of the stack extends outwardly through the opening. Because the stack extends outwardly through the opening, the overall thickness of the transducer is reduced.

4 Claims, 2 Drawing Sheets

MINIATURE TRANSDUCER

TECHNICAL FIELD

The present invention relates to miniature transducers, and more particularly, to a miniature transducer for a hearing aid, such as those designed for placement entirely within an ear canal.

BACKGROUND OF THE INVENTION

Transducers, such as for hearing aids, typically include a motor to drive a diaphragm, all disposed within a housing. The motor typically includes a coil, a yoke, such as a stack and an armature, which together form a magnetic circuit. It is often desired to contain electromagnetic flux generated by the magnetic circuit within the transducer. This is especially important when the transducer is used in conjunction with a hearing aid having a telecoil, as the flux can adversely affect the performance of the telecoil. In such circumstances, the transducer housing typically is made of magnetically shielded material and completely encases the motor. Because the housing completely encases the motor components, however, size reduction of the transducer has been hampered.

In certain applications where flux leakage is not a significant concern, the stack is exposed and positioned between two end caps, which contain the remaining components of the transducer. Such a transducer is disclosed in Knowles Electronics Inc.'s published PCT application WO 95/07014. However, this transducer can exhibit reduced mechanical strength because of the joints forming the exterior shell, i.e., the stack joined to the end caps.

The present invention is provided for these and other problems.

SUMMARY OF THE INVENTION

It is an object of the invention to provide a miniature transducer, such as for a hearing aid.

In accordance with the invention, the transducer comprises a housing defining an interior and an exterior and a motor including a coil, a stack and an armature disposed substantially within the housing. The housing is formed of a top cup joined to a bottom cup and includes an opening. The stack extends outwardly through the opening.

It is contemplated that the stack is flush with the housing.

It is further contemplated that the housing has a base surface and the opening is located in the base surface.

DETAILED DESCRIPTION

Figure 1:
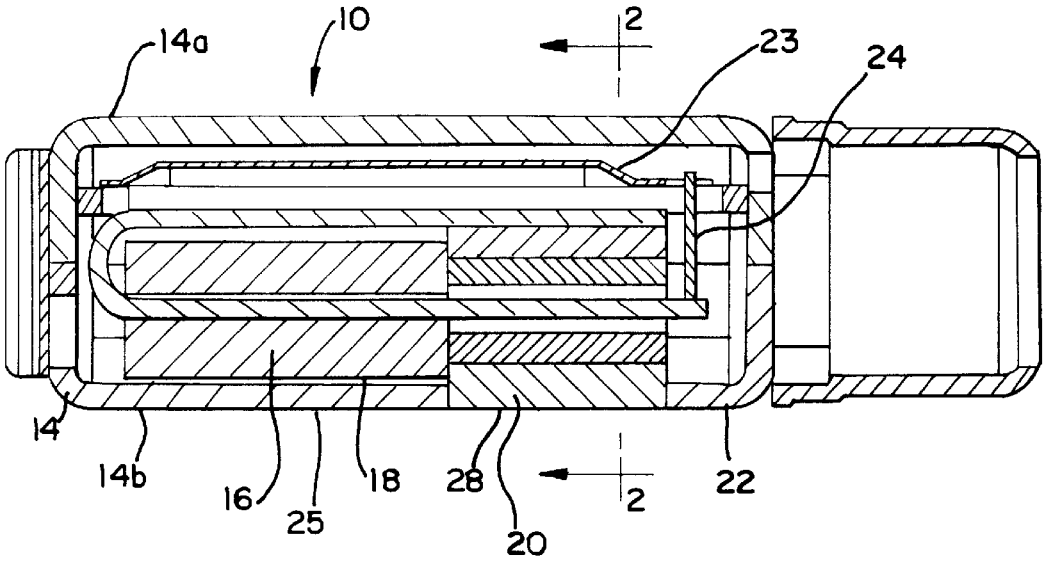
FIG. 1 is a side-sectional view of a receiver according to the present invention.
Figure 2:
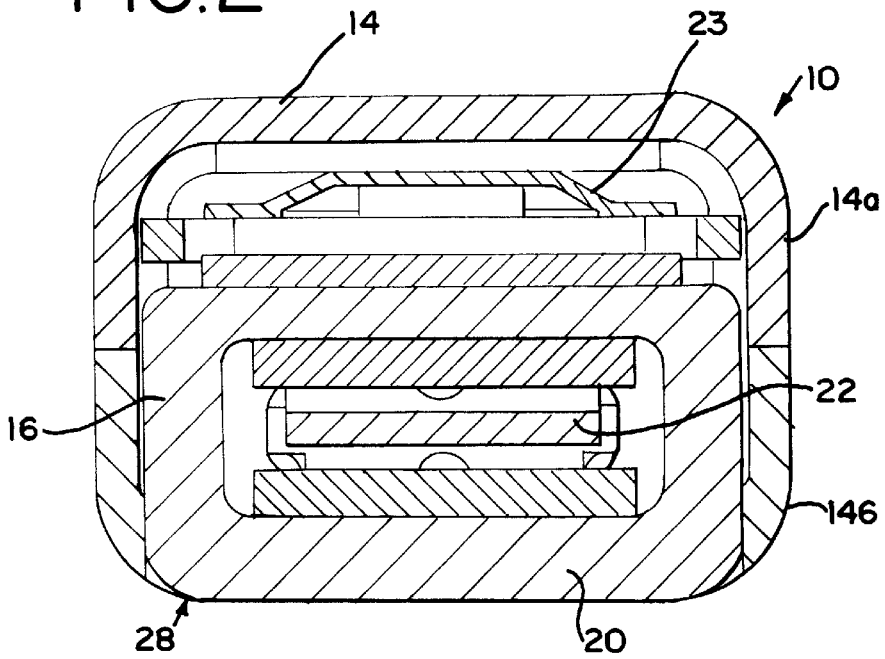
FIG. 2 is a sectional view of the receiver of FIG. 1, along lines 2—2 thereof.
Figure 3:
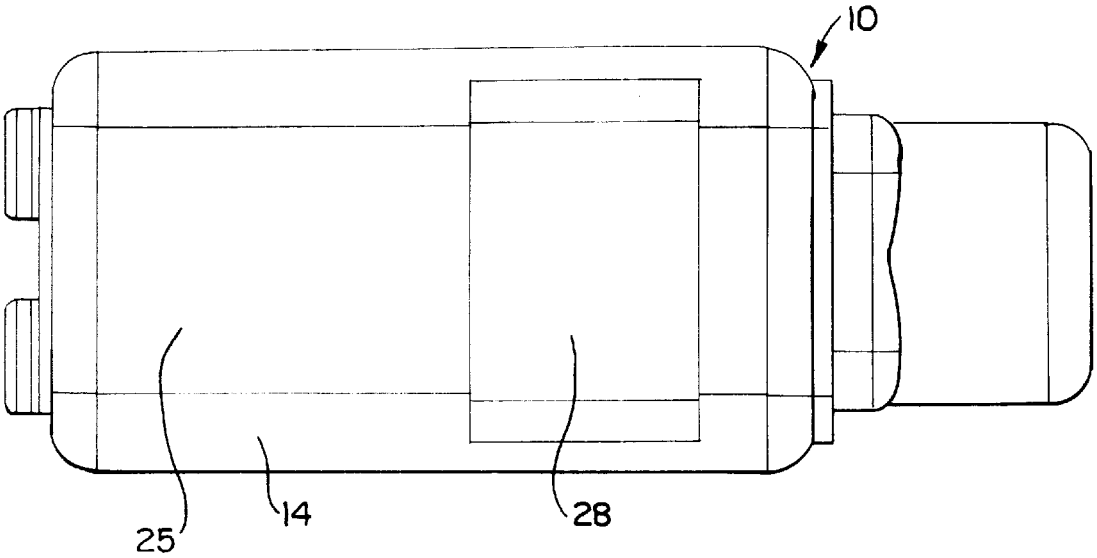
FIG. 3 is a bottom view of the receiver of FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

A miniature receiver, generally designated 10, is illustrated in FIGS. 1–4. The receiver comprises a housing 14 defining an interior and an exterior. The receiver 10 further comprises a motor 16 including a coil 18, a stack 20 and an armature 22 disposed substantially within the housing 14. Electric currents representing the sounds to be produced are moved through the coil 18. Current through the coil 18 displaces armature 22, which in turn displaces the drive pin 24, causing the diaphragm 23 to vibrate and create the desired sound. The housing 14 is formed of a top cup 14*a* joined to a bottom cup 14*b*. The bottom cup 14*b* includes a base surface 25 and a plurality of interconnected walls 26. An opening 28 is located in the base surface 25. The stack 20 extends outwardly through the opening 28. The stack 20 is flush with the housing 14. Because the stack 20 extends outwardly through the opening 28, and is not fully encased within the housing 14, the diaphragm 23 can be lowered, thereby significantly reducing the thickness of the receiver itself.

In the present embodiment, a conventional Knowles FK receiver having a thickness of 0.080" can be reduced in thickness by 0.005" to 0.0075", a reduction of over 6%. Because the stack remains substantially within the housing 14, stray flux is minimized.

Figure 5:
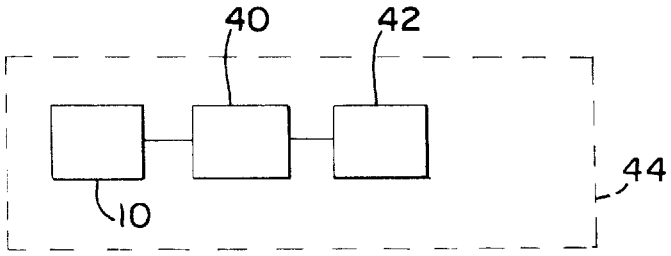
FIG. 5 is a block diagram of a hearing aid utilizing the receiver of FIG. 1.
Figure 4:
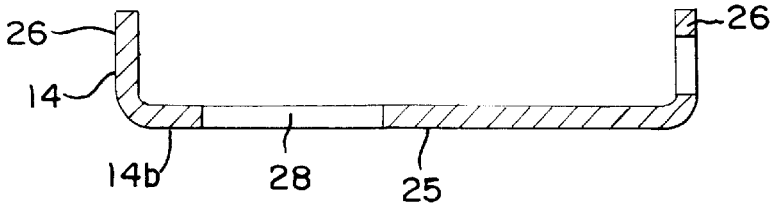
FIG. 4 is a sectional view of the bottom cup of the housing of the receiver of FIG. 1.

The receiver 10 can in particular be used in an in-the-canal (ITC) type hearing aid comprising a microphone 42, amplifier circuitry 40 and the receiver 10, contained within a hearing aid shell 44, as illustrated in FIG. 5.

While the specific embodiment has been illustrated and described, numerous modifications come to mind without significantly departing from the spirit of the invention and the scope of protection is only limited by the scope of the accompanying Claims.

I claim:

1. A hearing aid for placement within an ear canal, the hearing aid including a microphone, an amplifier and a receiver, the receiver comprising a housing defining an interior and an exterior; and a motor including a yoke disposed substantially within said housing, wherein said housing includes an opening and a portion of said yoke extends into said opening, wherein said receiver housing has a base surface and said opening is located in said base surface.

2. A hearing aid for placement within an ear canal, the hearing aid including a microphone, an amplifier and a receiver, the receiver comprising a housing defining an interior and an exterior; and a motor including a yoke disposed substantially within said housing, wherein said housing includes an opening and a portion of said yoke extends into said opening, wherein said receiver housing is formed of a top cup joined to a bottom cup, said bottom cup including a base surface and a plurality of interconnected walls, and said opening is located in said base surface.

3. A hearing aid for placement within an ear canal, the hearing aid including a microphone, an amplifier and a receiver, the microphone comprising a housing defining an interior and an exterior; and a motor including a yoke disposed substantially within said housing, wherein said housing includes an opening and a portion of said yoke extends outwardly through said opening, wherein said microphone housing has a base surface and said opening is located in said base surface.

4. A hearing aid for placement within an ear canal, the hearing aid including a microphone, an amplifier and a receiver, the microphone comprising a housing defining an interior and an exterior; and a motor including a yoke disposed substantially within said housing, wherein said housing includes an opening and a portion of said yoke extends outwardly through said opening, wherein said microphone housing is formed of a top cup joined to a bottom cup, said bottom cup including a base surface and a plurality of interconnected walls, and said opening is located in said base surface.

* * * * *